US006940335B2

(12) United States Patent
Otake

(10) Patent No.: US 6,940,335 B2
(45) Date of Patent: Sep. 6, 2005

(54) CONSTANT-VOLTAGE CIRCUIT

(75) Inventor: Hideyuki Otake, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/731,084

(22) Filed: Dec. 10, 2003

(65) Prior Publication Data

US 2004/0239414 A1 Dec. 2, 2004

(30) Foreign Application Priority Data

May 30, 2003 (JP) ..... 2003-155205

(51) Int. Cl.[7] ..... G05F 1/10
(52) U.S. Cl. ..... 327/538; 327/541; 327/543
(58) Field of Search ..... 327/427, 530, 327/538–541, 543; 323/313–317; 365/189.09

(56) References Cited

U.S. PATENT DOCUMENTS

| | | | | |
|---|---|---|---|---|
| 5,103,158 A | | 4/1992 | Cho et al. | 323/314 |
| 5,686,823 A | * | 11/1997 | Rapp | 323/313 |
| 5,856,756 A | | 1/1999 | Sasahara et al. | 327/540 |
| 5,942,809 A | | 8/1999 | Hashimoto | 307/43 |
| 6,060,918 A | | 5/2000 | Tsuchida et al. | 327/143 |
| 6,201,436 B1 | * | 3/2001 | Hur et al. | 327/543 |
| 6,528,978 B2 | * | 3/2003 | Lim | 323/313 |
| 6,529,411 B2 | | 3/2003 | Tonda et al. | 365/185.18 |

FOREIGN PATENT DOCUMENTS

| | | |
|---|---|---|
| JP | 05-205469 | 8/1993 |
| JP | 07-072943 | 3/1995 |
| JP | 7-110721 | 4/1995 |
| JP | 10-49243 | 2/1998 |
| JP | 2928531 | 5/1999 |
| JP | 2000-148264 | 5/2000 |
| JP | 2000-181558 | 6/2000 |
| JP | 2002-170391 | 6/2002 |

* cited by examiner

*Primary Examiner*—Long Nguyen
(74) *Attorney, Agent, or Firm*—Nixon Peabody LLP; Donald R. Studebaker

(57) ABSTRACT

A start signal (STA) at "H" causes a current to flow through a constant-current portion (10) and control voltages to be produced at nodes (N1, N2) for biasing of a reference voltage portion (20) and an output portion (30), respectively. This allows a predetermined current to flow through the reference voltage portion (20), and a reference voltage (VRF) to be output at a node (N4). With the start signal (STA) at "L", only a constant-voltage device (22) provides a reference voltage (VRF1), whereas the start signal (STA) at "H" causes the constant-voltage devices (22,23) to be connected in parallel to provide a reference voltage (VRF2). The reference voltage (VRF) is amplified at an output portion having a differential amplifier arranged in the voltage follower connection to output an internal voltage (VOUT) corresponding to the reference voltage (VRF).

6 Claims, 3 Drawing Sheets

—PRIOR ART—

CONSTANT-VOLTAGE CIRCUIT

BACKGROUND OF THE INVENTION

1. Field of the Invention

The present invention relates to a constant-voltage circuit which is provided in a semiconductor integrated circuit to generate a constant voltage to be supplied to the internal circuit of the integrated circuit.

2. Description of the Related Art

Reference can be had to Japanese Patent Application Kokai No. H5-205469, Japanese Patent No. 2928531, U.S. Pat. No. 5,103,158 and U.S. Pat. No. 5,942,809.

FIG. 2 illustrates the configuration of a conventional internal supply-voltage generation circuit which is disclosed in Japanese Patent Application Kokai No. H5-205469 mentioned above.

The internal supply-voltage generation circuit is provided in a semiconductor memory device to generate an internal supply-voltage VINT from an external supply voltage VEXT. The internal supply-voltage generation circuit includes a reference voltage generation portion 50, a voltage sense portion 100, a latch portion 200, a reference-voltage control portion 300, and an internal supply-voltage generation portion 400.

The voltage sense portion 100 senses a voltage applied to a pad PAD, with a plurality of load transistors P1 to P4 and a resistor R1 connected in series between the pad PAD and a ground voltage VSS. Additionally, there is provided an inverter chain formed of inverters INV1 to INV3 at a connection between the transistor P4 and the resistor R1. The output terminal of the inverter INV2 is connected to the gate of a switching transistor N1, while one channel terminal of the transistor N1 is connected to the output terminal of the inverter INV3. The other channel terminal of the transistor N1 is connected to the latch portion 200.

The latch portion 200 has a resistor R2 connected to the external supply voltage VEXT and inverters INV4, INV5 for transmitting and latching the electric potential to be formed by the accumulation of current via the resistor R2. The latch portion 200 successively supplies the output signal thereof to the reference-voltage control portion 300.

The reference-voltage control portion 300 includes a transmission gate TM1 to be controlled with the output signal from the latch portion 200 and a pull-up transistor T1 connected to the output of the transmission gate TM1. The reference voltage generation portion 50 and an internal supply-voltage generation portion 40, which are known to those skilled in the art, are connected to the input and output of the transmission gate TM1, respectively.

When conducting a test on a memory circuit, for example, in a burn-in test, a high voltage is applied to the interior of such an internal supply-voltage generation circuit. For example, a predetermined voltage (e.g., the external supply voltage VEXT) is applied to the pad PAD. The input of the inverter INV1 in the voltage sense portion 100 is at level "H", while the transistor N1 is turned on to output a level of "L." This causes the latch portion 200 to provide an output signal at level "H."

The transmission gate TM1 in the reference-voltage control portion 300 is thus turned off, thereby causing a reference voltage VREF from the reference voltage generator 50 to be interrupted. At this time, the gate of the transistor T1 is supplied with an inverted signal of the output signal from the latch portion 200 which has been inverted by the inverter INV6. This causes the transistor T1 to be turned on and the reference-voltage control portion 300 to output the external supply voltage VEXT, allowing the internal supply-voltage generation portion 400 to output the external supply voltage VEXT as the internal supply voltage VINT.

Now, during normal operation, i.e., when no voltage is applied to the pad PAD, the input of the inverter INV1 in the voltage sense portion 100 is at level "L". This causes the transistor N1 to be turned off. The resistor R2 pulls up the input of the latch portion 200 to level "H," allowing the latch portion 200 to provide an output signal of level "L." Thus, the transmission gate TM1 in the reference-voltage control portion 300 is turned on, allowing the reference voltage VREF output from the reference voltage generator 50 to be transmitted to the internal supply-voltage generation portion 400. At this time, the transistor T1 is turned off. This causes the internal supply-voltage generation portion 400 to output an internal supply voltage VINT corresponding to the reference voltage VREF.

However, the conventional internal supply-voltage generation circuit has the following problems. That is, the gate of the transistor T6 in the internal supply-voltage generation portion 400, described as prior art, is supplied with the reference voltage VREF or the external supply voltage VEXT from the reference-voltage control portion 300 in accordance with the operation mode. The transistor T6 controls a bias current flowing through a differential amplifier. Thus, depending on the level of the reference voltage VREF, the internal supply-voltage generation portion 400 may not operate properly, thereby possibly preventing a desired internal supply voltage VINT from being obtained.

SUMMARY OF THE INVENTION

To solve the aforementioned problems, the present invention provides a constant-voltage circuit which includes a constant-current portion, a reference voltage portion, and an output portion. The constant-current portion causes, when a start signal is in an active state, an electric current to start flowing to output a first control signal and a second control signal of predetermined levels and continue outputting the first and second control signals even after the start signal is in an inactive state. The reference voltage portion outputs a first reference voltage in response to said first control signal while the state signal is in said inactive state and outputs a second reference voltage higher than the first reference voltage in response to said first control signal while said start signal is in said active state. The output portion outputs a constant internal voltage corresponding to the first or second reference voltage which is output from the reference voltage portion when the second control signal is supplied.

According to the present invention, the constant-voltage circuit is configured as described above to operate in the following manner.

When an external supply voltage is applied and a start signal is further supplied to the constant-voltage circuit, a current starts flowing through the constant-current portion to output the first and second control signals at predetermined levels. The first control signal is supplied to the reference voltage portion, and the start signal supplied at the same time causes the reference voltage portion to output the second reference voltage. The second reference voltage is supplied to the output portion, which in turn outputs a constant internal voltage corresponding to the second reference voltage.

Even when the start signal is ceased, the constant-current portion continues outputting the first and second control signals. The ceasing of the start signal causes the reference voltage portion to output the first reference signal, which is lower than the second reference signal, instead of the second reference signal. The first reference voltage is supplied to the output portion, which in turn outputs a constant internal voltage corresponding to the first reference voltage.

DETAILED DESCRIPTION OF THE INVENTION

First Embodiment

Figure 1:
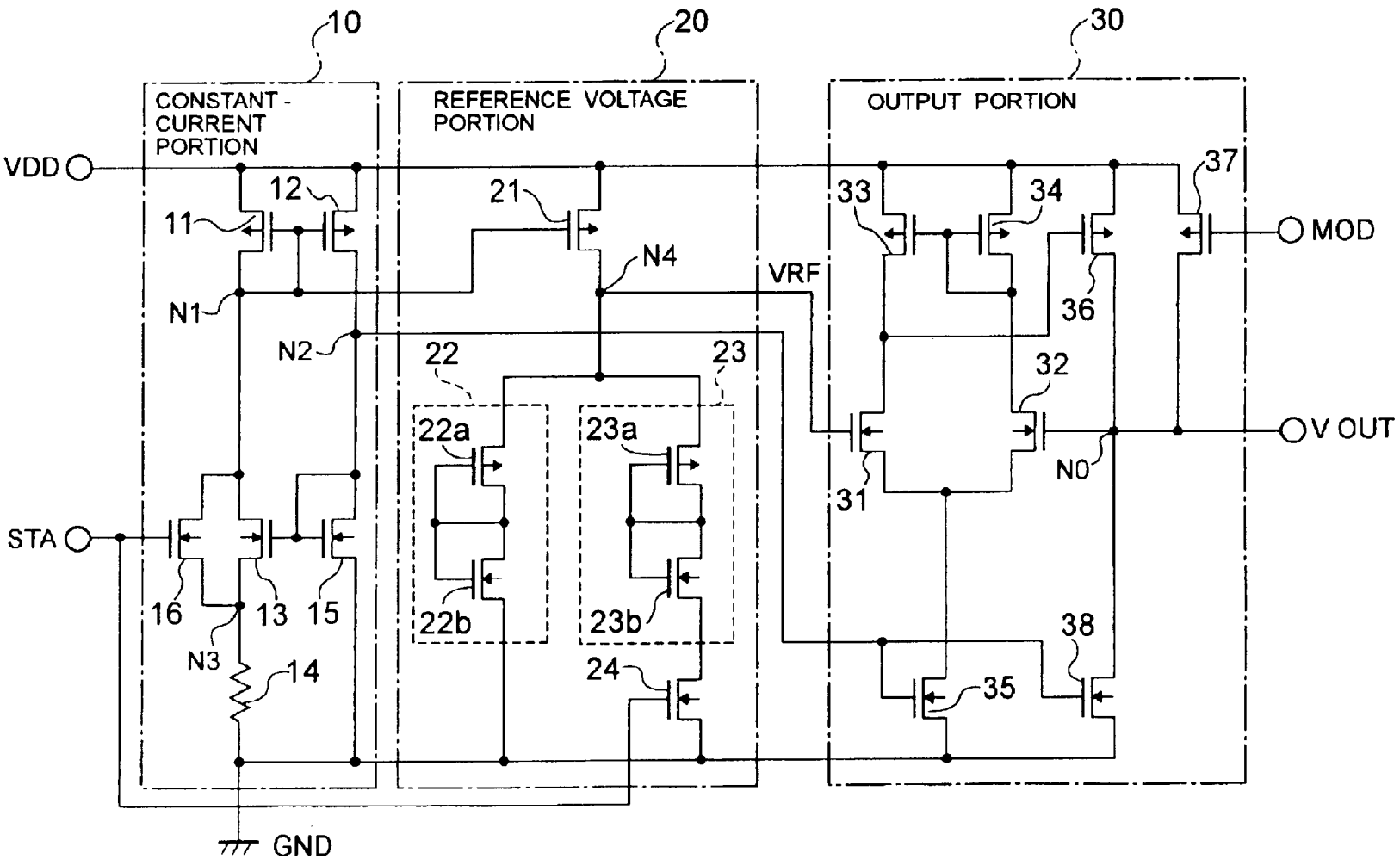
FIG. 1 is a circuit diagram illustrating a constant-voltage circuit according to a first embodiment of the present invention.
Figure 2:
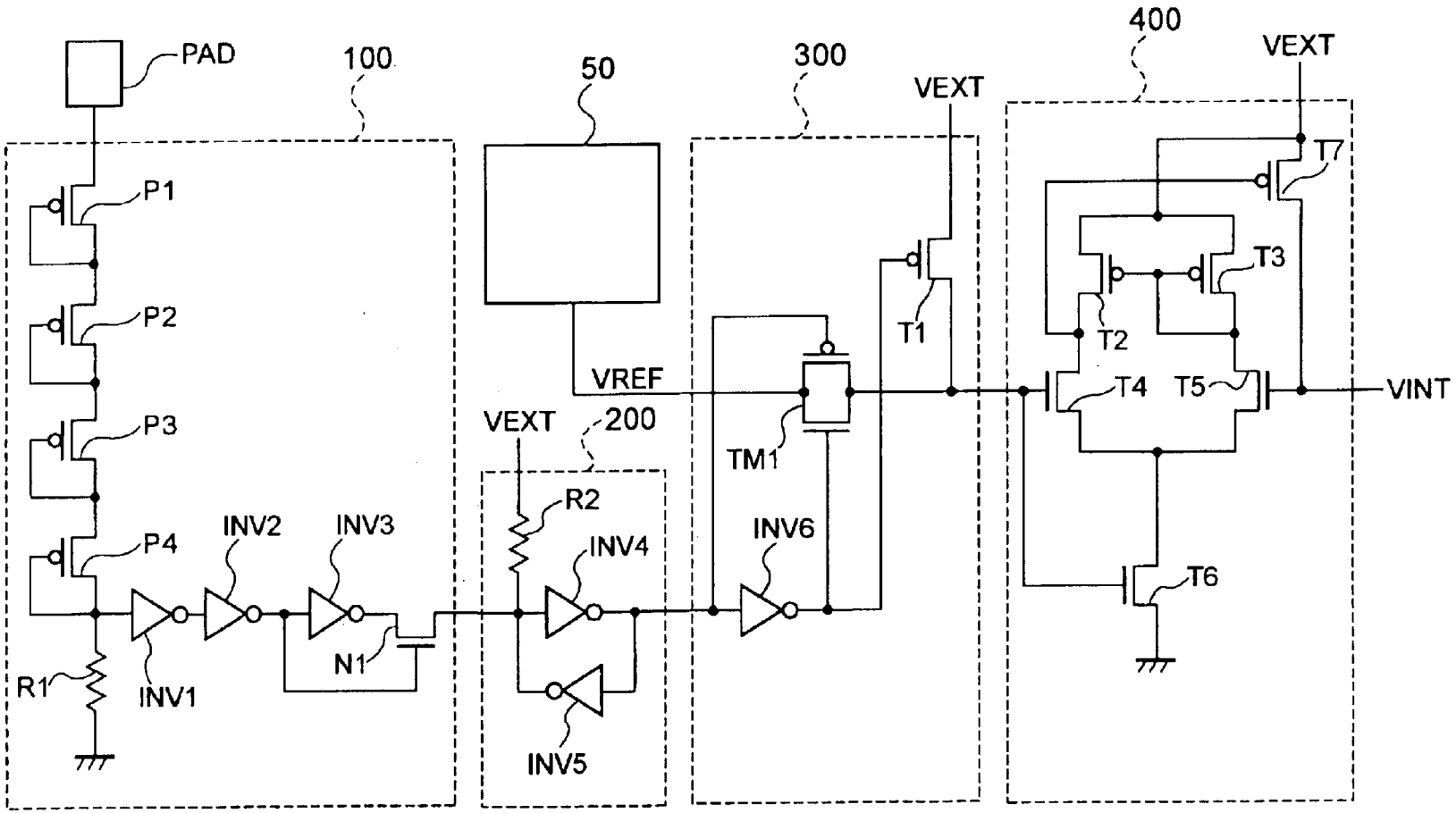
FIG. 2 is a view illustrating the configuration of a conventional internal supply-voltage generation circuit.

FIG. 1 is a circuit diagram illustrating a constant-voltage circuit according to a first embodiment of the present invention.

The constant-voltage circuit is provided in a semiconductor integrated circuit to generate a constant internal voltage VOUT, which is supplied to the interior of the semiconductor integrated circuit, from a supply voltage VDD (e.g., 5V) that is provided externally. The constant-voltage circuit includes a constant-current portion 10, a reference voltage portion 20, and an output portion 30.

The constant-current portion 10 includes P-channel MOS transistors (hereinafter, also simply referred to as "PMOS") 11, 12 with the sources supplied with the supply voltage VDD and the drains connected to nodes N1, N2, respectively. The gates of the PMOS transistors 11, 12 are connected to the node N1. The drain of an N-channel MOS transistor (hereinafter, also simply referred to as "NMOS") 13 is connected to the node N1. The source of the NMOS 13 is connected to a node N3, which is in turn connected to the ground voltage GND via a resistor 14.

On the other hand, the drain of an NMOS 15 is connected to the node N2, while the source of the NMOS 15 is connected to the ground voltage GND. The gates of the NMOS transistors 13, 15 are connected to the node N2. The drain and source of the NMOS 13 are connected to the drain and source of an NMOS 16, respectively. The gate of the NMOS 16 is supplied with a start signal STA for start-up. The constant-current portion 10 outputs control voltages from the nodes N1, N2 to control the bias currents for the reference voltage portion 20 and the output portion 30, respectively.

The reference voltage portion 20 includes a PMOS 21 with the source supplied with the supply voltage VDD and the gate and drain connected to the node N1 and a node N4, respectively. One terminal of constant-voltage device 22 and one terminal of constant-voltage device 23 are connected to the node N4. The other terminal of the constant-voltage device 22 is directly connected to the ground voltage GND, while the other terminal of the constant-voltage device 23 is connected to the ground voltage GND via an NMOS 24, which is controllably turned on or off with the start signal STA.

The constant-voltage devices 22, 23 are configured in a similar manner to each other. For example, the constant-voltage device 22 has a PMOS 22*a* and an NMOS 22*b* connected in series in the forward direction, each of the PMOS 22*a* and the NMOS 22*b* being configured to have a diode connection. The reference voltage portion 20 allows the constants of the constant-voltage devices 22, 23 such as their dimensions to be adjusted, thereby outputting a reference voltage VRF1 of, for example, 1.7V to the node N4 when a predetermined bias current flows only through the constant-voltage device 22. On the other hand, the reference voltage portion 20 outputs a reference voltage VRF2 of about 3.0V, which is higher than the reference voltage VRF1, when a predetermined bias current flows through both the constant-voltage devices 22, 23.

The output portion 30 is a buffer amplifier having a differential amplifier arranged in the voltage follower connection, in which the gate of an NMOS 31 corresponding to a non-inverting input terminal is connected to the node N4 and the gate of an NMOS 32 corresponding to a non-inverting input terminal is connected to an output node NO. The drains of the NMOS transistors 31, 32 are connected to the supply voltage VDD via PMOS transistors 33, 34, respectively, while the gates of the PMOS transistors 33, 34 are connected to the drain of the NMOS 32. The sources of the NMOS transistors 31, 32 are connected to the ground voltage GND via a NMOS 35.

Additionally, there are PMOS transistors 36, 37 connected in parallel between the output node NO and the supply voltage VDD. The gate of the PMOS 36 is connected to the drain of the NMOS 31, while the gate of the PMOS 37 is supplied with a mode signal MOD. There is an NMOS 38 connected between the output node NO and the ground voltage GND, and the gate of the NMOS 38 is connected to the node N2 of the constant-current portion 10 along with the gate of the NMOS 35. The internal voltage VOUT is delivered or output from the output node NO.

Now, the operation of the constant-voltage circuit shown in FIG. 1 is described with respect to a start mode (1), a normal mode (2), and a high-load mode (3).

(1) Start mode

With the start signal STA and the mode signal MOD at "L" and "H" levels, respectively, applying the supply voltage VDD (e.g., 5V) to the constant-current portion 10 causes all the transistors therein to remain in the off state. This causes the nodes N1, N2 to be a high-impedance condition, and the reference voltage portion 20 and the output portion 30 to stop operating and output no internal voltage VOUT.

In the foregoing, the start signal STA at "H" will turn on the NMOS 16 to activate the constant-current portion 10, allowing a certain amount of current to flow through the PMOS 11, the NMOS transistors 13, 16, and the resistor 14., the currents being defined by the circuit constants thereof. Likewise, a certain amount of current also flows through the PMOS 12 and the NMOS 15. This allows a control voltage for controlling the bias current in each of the reference voltage portion 20 and the output portion 30 to be output at the nodes N1, N2.

In the reference voltage portion 20, the PMOS 21 turned on by the control voltage at the node N1 and the NMOS 24 turned on by the start signal STA cause the reference voltage VRF2 (3V) combined in the two constant-voltage devices 22, 23 to be output from the node N4. The reference voltage VRF2 is supplied to the gate of the NMOS 31 in the output portion 30.

In the output portion 30, the differential amplifier arranged in the voltage follower connection operates to supply the output level at the drain of the NMOS 31 to the gate of the PMOS 36. The voltage at the drain of the PMOS 36, i.e., the internal voltage VOUT is fed back to the gate of the NMOS 32. This provides control of the conduction state of the PMOS 36 so as to provide the same level at the gates of the NMOS transistors 31, 32, allowing the output node NO to output the internal voltage VOUT of 3V, which is at the same level as the reference voltage VRF2.

(2) Normal mode

The start signal STA is turned to "H" thereby allowing the constant-voltage circuit to operate and output the internal voltage VOUT of 3V in the start mode, and the start signal STA is then changed to "L" to place the constant-voltage circuit in the normal mode.

In the constant-current portion 10, the start signal STA at "L" turns off the NMOS 16; however, the NMOS 13 connected in parallel thereto has been already turned on and thus the constant-current portion 10 continues operating. On the other hand, in the reference voltage portion 20, the start signal STA at "L" turns off the NMOS 24. This causes the constant-voltage device 23 to be disconnected, allowing the reference voltage VRF1 (1.7V) from only the constant-voltage device 22 to be output from the node N4. Additionally, the reference voltage VRF1 is power amplified in the output portion 30, allowing the internal voltage VOUT of 1.7V to be output from the output node NO.

(3) High-load Mode

In a high-load mode in which the supply voltage VDD is directly applied to the interior circuit as the internal voltage VOUT in the burn-in test, the mode signal MOD is set at "L". This allows the PMOS 37 in the output portion 30 to be turned on, and the supply voltage VDD to be directly output as the internal voltage VOUT irrespective of the start signal STA or the operation of the constant-current portion 10 and the reference voltage portion 20.

As described above, the constant-voltage circuit of the first embodiment allows the constant-current portion 10 to generate a control voltage for controlling the bias current of the reference voltage portion 20 and the output portion 30. This makes it possible to output the normal reference voltage VRF2 even at the time of starting and always supply a stable internal voltage VOUT.

Since different internal voltages VOUT can be output in the start and normal modes, it is possible to supply an appropriate internal voltage in accordance with the operation mode. Furthermore, the NMOS 16 for use in starting is connected in parallel to the NMOS 13 for use with constant current. In the start mode, this configuration allows the resistor 14 to limit the current flowing through the constant-current portion 10 even with the NMOS 16 turned on, thereby providing an advantage of preventing an excessive current from flowing therethrough.

Second Embodiment

Figure 3:
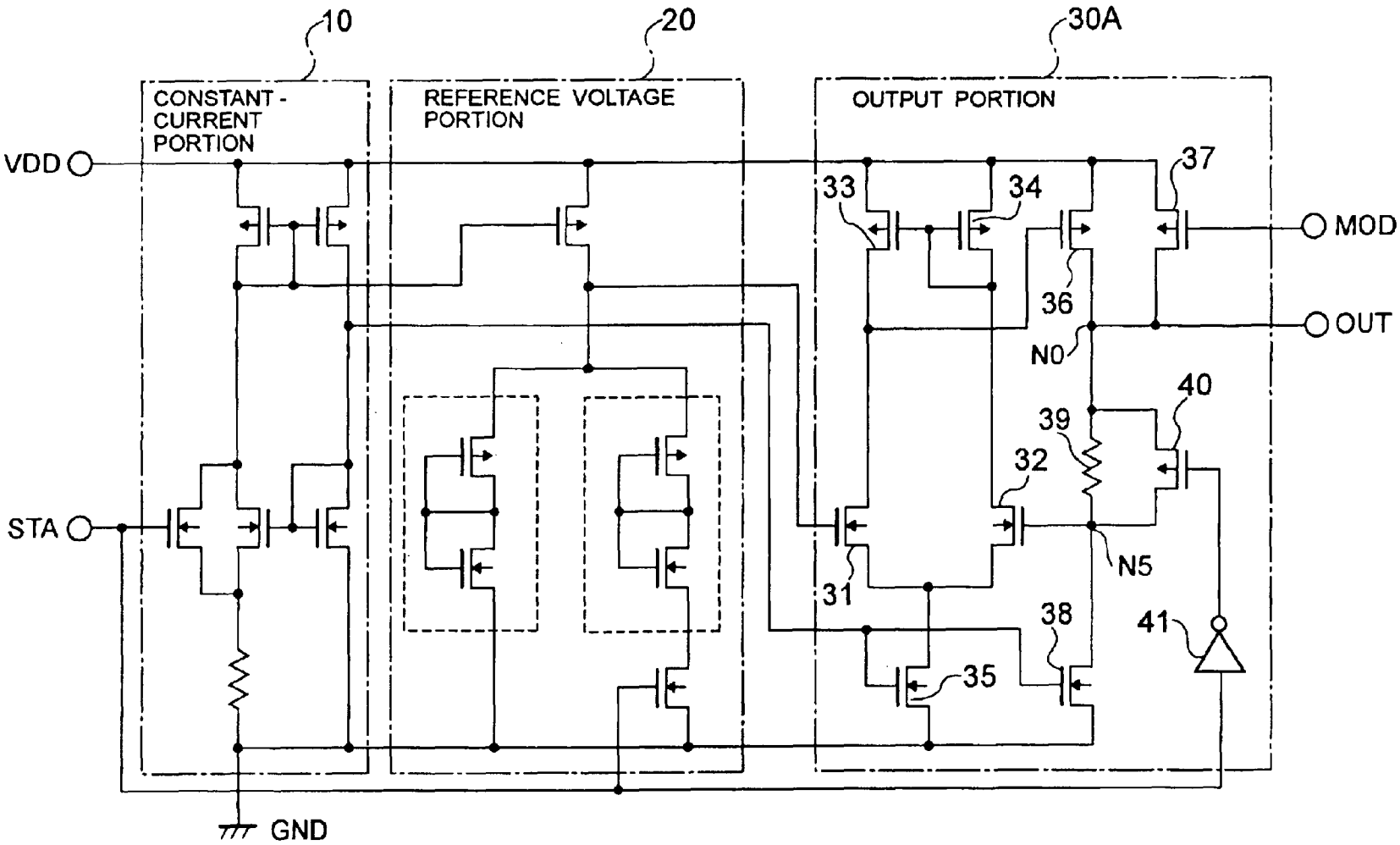
FIG. 3 is a circuit diagram illustrating a constant-voltage circuit according to a second embodiment of the present invention.

FIG. 3 is a circuit diagram illustrating a constant-voltage circuit according to a second embodiment of the present invention, in which the components similar to those of FIG. 1 are indicated with the same symbols.

Instead of the output portion 30 of the constant-voltage circuit shown in FIG. 1, the constant-voltage circuit of the embodiment is provided with an output portion 30A having a configuration slightly different from that of the output portion 30. In the output portion 30A, the drains of the PMOS transistors 36, 37 are connected to the output node NO, and a resistor 39 is provided between the output node NO and a node N5 to which the gate of the NMOS 32 is connected. Additionally, there is provided a switching PMOS 40 connected in parallel to the resistor 39, such that the inverted signal of the start signal STA through an inverter 41 is applied to the gate of the PMOS 40 for control between on and off operation. The configuration of the other configuration is similar to that in FIG. 1.

Now, the operation is described below. At the time of starting, the supply voltage VDD is applied with the start signal STA and the mode signal MOD at levels of "L" and "H", respectively. The start signal STA is then changed to "H" causing the output signal from the inverter 41 in the output portion 30A to be changed to "L." This causes the PMOS 40 to be turned on and thus the resistor 39 to be short-circuited, providing a constant-voltage circuit similar to that of FIG. 1. Accordingly, the operation in the start mode is similar to that of the constant-voltage circuit of FIG. 1.

Then, when the start signal STA is changed to "L" for the circuit to be in the normal mode, the PMOS 40 is turned off to allow the resistor 39 to appear between the output node NO and the gate of the NMOS 32. This allows the voltage corresponding to the internal voltage VOUT reduced by a voltage drop across the resistor 39 to be fed back to the gate of the NMOS 32. Suppose that the voltage drop across the resistor 39 is V39. In this case, since the differential amplifier in the output portion 30 operates such that the NMOS transistors 31, 32 provide the same level at their gates, the value obtained by subtracting the voltage V39 from the internal voltage VOUT is equal to the reference voltage VRF1. Therefore, the internal voltage VOUT turns out to be the reference voltage VRF1 plus the voltage V39. In general, the temperature characteristic of a constant-voltage device with transistors has a negative temperature gradient, whereas the temperature characteristic of resistors has a positive temperature gradient. This causes the temperature characteristic of the internal voltage VOUT to be canceled out, thereby reducing the gradient of the temperature characteristic.

On the other hand, the operation in a high-load mode in which the mode signal MOD is set at "L" is similar to that of the constant-voltage circuit of FIG. 1.

As described above, the constant-voltage circuit according to the second embodiment is configured such that the resistor 39 is inserted between the output node NO and the gate of the NMOS 32 in the normal mode. In addition to the same advantage as that of the first embodiment, this configuration provides an advantage of reducing a temperature-dependent variation in the internal voltage VOUT.

The present invention is not limited to the aforementioned embodiments and various modifications can be made thereto. For example, the following modifications can also be made.

(a) The circuit configuration of the constant-current portion 10, the reference voltage portion 20, and the output portion 30 is not limited to those described above. As long as the circuits have similar capabilities, any circuit configurations may also be applicable.

(b) The output portion 30 has the PMOS 37 for directly outputting the supply voltage VDD as the internal voltage VOUT when the high-load mode is designated by the mode signal MOD. However, when such a capability is not required, the configuration can be eliminated.

As described above in detail, the constant-voltage circuit according to the first invention includes the constant-current portion that is started by a start signal to output the first and second control signals, and the reference voltage portion and the output portion, which are controlled by the first and second control signals, respectively. This configuration allows the reference voltage portion to generate a stable reference voltage, and the output portion to output a stable internal voltage. The reference voltage portion can also produce two types of reference voltages in accordance with the presence or absence of the start signal.

The constant-voltage circuit according to the second and fifth inventions includes switching means for outputting an externally applied supply voltage as the internal voltage when a mode signal designates a high-load mode. This makes it possible to switch among three types of internal voltages for output.

The constant-voltage circuit according to the third invention has a resistor, for producing a constant current, disposed in series with the fifth transistor having a conduction state controlled by the start signal. This eliminates the possibility of a large current flowing through the constant-current portion in the start mode.

The constant-voltage circuit according to the fourth invention has a resistor disposed in the feedback loop of the output portion. This allows the negative temperature characteristic of the semiconductor constant-voltage devices to be canceled out by the positive temperature characteristic of the resistor, thereby making it possible to provide an internal voltage with reduced temperature-dependent variations.

The invention has been described with reference to the preferred embodiments thereof. It should be understood by those skilled in the art that a variety of alterations and modifications may be made from the embodiments described above. It is therefore contemplated that the appended claims encompass all such alterations and modifications.

This application is based on Japanese Patent Application No. 2003-155205 which is hereby incorporated by reference.

What is claimed is:

1. A constant-voltage circuit comprising:

a constant-current portion for allowing an electric current to start flowing, when a start signal is in an active state, to output a first control signal and a second control signal of predetermined levels, respectively, and continue outputting said first and second control signals after said start signal is in an inactive state;

a reference voltage portion for outputting a first reference voltage in response to said first control signal while the start signal is in said inactive state and for outputting a second reference voltage higher than said first reference voltage in response to said first control signal while said start signal is in said active state; and an output portion for outputting a constant internal voltage corresponding to either one of said first and second reference voltages output from said reference voltage portion in response to said second control signal.

2. The constant-voltage circuit according to claim 1, wherein said output portion includes switching means for outputting an externally applied supply voltage as said constant internal voltage irrespective of said second control signal and said first or second reference voltages when a mode signal designating a high-load mode is in an active state.

3. The constant-voltage circuit according to claim 1, wherein said constant-current portion comprises:

a first transistor connected between a first node for outputting said first control signal and a source potential, the conduction state of said first transistor being controlled by said first control signal;

a second transistor connected between a second node for outputting said second control signal and the source potential, the conduction state of said second transistor being controlled by said first control signal;

a third transistor connected between said first node and a third node, the conduction state of said third transistor being controlled by said second control signal;

a resistor connected between said third node and a ground potential;

a fourth transistor connected between said second node and the ground potential, the conduction state of said fourth transistor being controlled by said second control signal; and a fifth transistor connected between said first node and said third node, the conduction state of said fifth transistor being controlled by said start signal, said reference voltage portion comprises:

a sixth transistor connected between a fourth node, for outputting said first and second reference voltages, and the source potential, the conduction state of said sixth transistor being controlled by said first control signal;

a first constant-voltage device connected between said fourth node and the ground potential, and a second constant-voltage device to be connected in parallel to said first constant-voltage device when said start signal is in said active state, and said output portion comprises:

a differential amplifier having a non-inverting input terminal provided with one of said first and second reference voltages, an inverting input terminal connected to an output node for outputting said internal voltage, the bias current of said differential amplifier being controlled by said second control signal;

a seventh transistor connected between the source potential and said output node, the conduction state of said seventh transistor being controlled by an output signal from said differential amplifier; and an eighth transistor connected between said output node and the ground potential, the conduction state of said eighth transistor being controlled by said second control signal.

4. The constant-voltage circuit according to claim 1, wherein said constant-current portion comprises:

a first transistor connected between a first node for outputting said first control signal and a source potential, the conduction state of said first transistor being controlled by said first control signal;

a second transistor connected between a second node for outputting said second control signal and the source potential, the conduction state of said second transistor being controlled by said first control signal;

a third transistor connected between said first node and a third node, the conduction state of said third transistor being controlled by said second control signal;

a first resistor connected between said third node and a ground potential;

a fourth transistor connected between said second node and the ground potential, the conduction state of said fourth transistor being controlled by said second control signal; and a fifth transistor connected between said first node and said third node, the conduction state of said fifth transistor being controlled by said start signal, said reference voltage portion comprises:

a sixth transistor connected between a fourth node, for outputting said first and second reference voltages, and the source potential, the conduction state of said sixth transistor being controlled by said first control signal;

a first constant-voltage device connected between said fourth node and the ground potential; and a second constant-voltage device to be connected in parallel to said first constant-voltage device when said start signal is in said active state, and said output portion comprises:

a differential amplifier having a non-inverting input terminal provided with one of said first and second reference voltages, an inverting input terminal connected to a fifth node, the bias current of said differential amplifier being controlled by said second control signal;

a seventh transistor connected between the the source potential and an output node for outputting said internal voltage, the conduction state of said seventh transistor being controlled by an output signal from said differential amplifier, a second resistor connected between said output node and said fifth node, an eighth transistor connected between said fifth node and the ground potential, the conduction state of said eighth transistor being controlled by said second control signal, and a ninth transistor connected in parallel to said first resistor, the conduction state of said ninth transistor being controlled by said start signal.

5. The constant-voltage circuit according to claim 3, wherein said output portion includes a switching transistor connected between the source potential and said output node, the conduction state of said switching transistor being controlled by a mode signal.

6. The constant-voltage circuit according to claim 4, wherein said output portion includes a switching transistor connected between the source potential and said output node, the conduction state of said switching transistor being controlled by a mode signal.

* * * * *